US007773059B2

(12) United States Patent
Jeon et al.

(10) Patent No.: US 7,773,059 B2
(45) Date of Patent: Aug. 10, 2010

(54) ORGANIC ELECTROLUMINESCENT DISPLAY DEVICE AND DRIVING METHOD THEREOF

(75) Inventors: Chang-Hoon Jeon, Gyeongbuk (KR); Jin Huh, Gyeongbuk (KR)

(73) Assignee: LG Display Co., Ltd., Seoul (KR)

( * ) Notice: Subject to any disclaimer, the term of this patent is extended or adjusted under 35 U.S.C. 154(b) by 985 days.

(21) Appl. No.: 11/476,771

(22) Filed: Jun. 29, 2006

(65) Prior Publication Data

US 2007/0080909 A1 Apr. 12, 2007

(30) Foreign Application Priority Data

Oct. 11, 2005 (KR) ..... 2005-0095213

(51) Int. Cl.
*G09G 3/30* (2006.01)

(52) U.S. Cl. ..... 345/77; 345/76; 345/55

(58) Field of Classification Search ..... 345/76, 345/77, 55, 82

See application file for complete search history.

(56) References Cited

U.S. PATENT DOCUMENTS 4,589,019 A * 5/1986 Dischert et al. ..... 348/688
6,229,506 B1 * 5/2001 Dawson et al. ..... 345/82
6,348,906 B1 * 2/2002 Dawson et al. ..... 345/82
7,239,295 B2 * 7/2007 Kang et al. ..... 345/63
7,317,435 B2 * 1/2008 Hsueh ..... 345/82
7,408,533 B2 * 8/2008 Eom et al. ..... 345/76
7,486,264 B2 * 2/2009 Taguchi ..... 345/87
7,537,441 B2 * 5/2009 Iwasaki ..... 418/206.6
2005/0007357 A1 * 1/2005 Yamashita et al. ..... 345/204
2005/0264499 A1 * 12/2005 Kim et al. ..... 345/76
2006/0152452 A1 * 7/2006 Hoppenbrouwers et al. ... 345/77
2006/0170623 A1 * 8/2006 Naugler et al. ..... 345/76
2007/0008254 A1 * 1/2007 Chu et al. ..... 345/77

FOREIGN PATENT DOCUMENTS

WO WO 2005006291 A1 * 1/2005

* cited by examiner

*Primary Examiner*—Amare Mengistu
*Assistant Examiner*—Dmitriy Bolotin
(74) *Attorney, Agent, or Firm*—Morgan Lewis & Bockius LLP

(57) ABSTRACT

A method of driving an organic electroluminescent display device, including measuring a gray level of an image, turning on a sampling transistor connected to gate electrode and drain electrode of a driving transistor during a sampling time, applying a data voltage to operate the driving transistor, and supplying a current to an light emitting diode through the driving transistor.

24 Claims, 5 Drawing Sheets

ORGANIC ELECTROLUMINESCENT DISPLAY DEVICE AND DRIVING METHOD THEREOF

The present invention claims the benefit of Korean Patent Application No. 2005-0095213, filed in Korea on Oct. 11, 2005, which is hereby incorporated by reference.

BACKGROUND OF THE INVENTION

1. Field of the Invention

The present invention relates to an organic electroluminescent display (OELD) device, and more particularly, to a method and apparatus for driving an OELD device.

2. Discussion of the Related Art

In general, display devices include cathode-ray tubes (CRT) and various types of flat panel displays. However, the various types of flat panel displays, such as liquid crystal display (LCD) devices, plasma display panel (PDP) devices, field emission display (FED) devices, and electroluminescent display (ELD) devices, are currently being developed as substitutes for the CRT. For example, advantages of LCD devices include a thin profile and low power consumption. However, LCD devices require a backlight unit because they are non-luminescent display devices. Organic electroluminescent display (OELD) devices, however, are self-luminescent display devices. OELD devices operate at low voltages and have a thin profile. Further, the OELD devices have fast response time, high brightness, and wide viewing angles.

FIG. 1 is a circuit diagram illustrating an OELD device according to the related art. As illustrated in FIG. 1, the OELD device of the related art includes a gate line SL and a data line DL perpendicular to the gate line SL. A pixel includes a switching transistor T1, a driving transistor T2, a capacitor C, and an organic light emitting diode OLED. The switching transistor T1 is connected to the gate line SL and data line DL. A gate electrode of the driving transistor T2 is connected to the switching transistor T1. A source electrode of the driving transistor T2 is connected to a power line $V_{DDL}$. A capacitor C is connected to the source and gate electrodes of the driving transistor T2. An anode of the organic light emitting diode OLED is connected to the driving transistor T2, and a cathode of the organic light emitting diode OLED is connected to a ground terminal $V_{SS}$. A plurality of pixels having the above pixel structure are arranged in a matrix to form the OELD device.

When the switching transistor T1 is turned on, a data voltage is applied to the driving transistor T2 and a diode current ($I_{OLED}$) is provided to the organic light emitting diode OLED to emit light. The capacitor C stores the data voltage applied to the driving transistor T2. The diode current ($I_{OLED}$) is expressed as follows:

$$I_{OLED}=\beta/2(V_{gs}-V_{th})^2=\beta/2(V_{DDL}-V_{data}-V_{th})^2,$$

where β is a constant; $V_{gs}$ is a voltage between gate and source electrodes of the driving transistor T2; $V_{th}$ is a threshold voltage of the driving transistor T2; $V_{data}$ is a data voltage; and $V_{DDL}$ is a power voltage. The diode current ($I_{OLED}$) depends on a threshold voltage ($V_{th}$) of the driving transistor T2. Thus, the operation of a pixel is influenced by the threshold voltage ($V_{th}$) property of the driving transistor T2. The different pixels in the OELD device may have different threshold voltages ($V_{th}$) due to variations in fabrication processes. This threshold voltage variation causes the diode currents ($I_{OLED}$) of different pixels to vary.

To resolve this problem, a voltage compensation type OELD device is suggested. FIG. 2A is a circuit diagram illustrating a voltage compensation type OELD device according to the related art. FIG. 2B is a waveform view illustrating signals applied to the OELD device of FIG. 2A.

As illustrated in FIG. 2A, a pixel includes four transistors T1, T2, T3, and T4. A switching transistor T1 is connected to a gate line SL and a data line DL. A driving transistor T2 is connected to a power line $V_{DDL}$. An emitting control transistor T4 is connected to an organic light emitting diode OLED, and a gate electrode of the emitting control transistor T4 is connected to an emitting control line ECL. A sampling transistor T3 is connected to gate and drain electrodes of the driving transistor T2. A gate electrode of the driving transistor T3 is connected to a sampling line SPL. A first capacitor C1 is connected to a drain electrode of the switching transistor T1 and a source electrode of the driving transistor T2. A second capacitor C2 is connected to the drain electrode of the switching transistor T1 and the gate electrode of the driving transistor T2.

As shown in FIG. 2B, when the gate line SL is applied with a low level gate voltage, the switching transistor T1 is turned on, and thus the driving transistor T2 is turned on. When the sampling line SPL is applied with a low level sampling clock signal, the sampling transistor T3 is turned on. During a sampling time ST, an offset voltage of the driving transistor T2 is sampled, and the offset voltage is stored in the second capacitor C2. The gate electrode of the driving transistor T2 has a voltage ($V_{DDL}-V_{th}$) during the sampling time ST. Then, when the sampling line SPL is applied with a high level sampling clock signal, a data voltage ($V_{data}$) is applied to the data line DL and stored in the first capacitor C1 through the turned-on switching transistor T1. When the data voltage ($V_{data}$) is applied, the gate electrode of the driving transistor T2 has a voltage ($V_{DDL}-V_{th}-V_{data}$).

A high level emitting control signal is applied to the emitting control line ECL during the sampling time ST to turn off the emitting control transistor T4. By turning off the emitting control transistor T4, a diode current ($I_{OLED}$) does not flow through the organic light emitting diode OLED. After the sampling time ST, a low level emitting control signal is applied to the emitting control transistor T4, and the emitting control transistor T4 is turned on such that the diode current ($I_{OLED}$) flows through the organic light emitting diode OLED.

As explained above, the threshold voltage ($V_{th}$) of the driving transistor T2 is sampled and stored before the data voltage ($V_{data}$) is applied to operate the driving transistor T2. Accordingly, when the driving transistor T2 is normally operated to display an image, the threshold voltage ($V_{th}$) property of the driving transistor is offset. Hence, the diode current ($I_{OLED}$) variation between the different pixels due to a threshold voltage ($V_{th}$) deviation of the driving transistor T2 is compensated, and the pixel operates without an influence of the threshold voltage ($V_{th}$) property.

In addition, an S-factor sometimes influences the operation of the driving transistor T2. That is, the diode current ($I_{OLED}$) is influenced by not only the threshold voltage ($V_{th}$), but also by the S-factor. For instance, a high gray level (i.e., bright gray level) displayed by a high diode current ($I_{OLED}$) is influenced by the threshold voltage ($V_{th}$) property. In other words, the high gray level is not influenced by the S-factor property of the driving transistor T2. On the other hand, a low gray level (i.e., dark gray level) displayed by a low diode current ($I_{OLED}$) is influenced by the threshold voltage ($V_{th}$) property and the S-factor property.

Therefore, a short sampling time is preferred for storing an offset voltage of the driving transistor when the gray level is not influenced by the S-factor property, and a long sampling time is preferred for storing the offset voltage of the driving transistor T2 when the gray level is influenced by S-factor property. However, the sampling time in the related art OELD is fixed. Therefore, images of various gray levels are not displayed uniformly. In other words, an image of a gray level adequate for the fixed sampling time is displayed properly, but other images of gray levels inadequate for the fixed sampling time are not displayed properly. Therefore, in the related art OELD device, display uniformity is degraded.

SUMMARY OF THE INVENTION

Accordingly, the present invention is directed to an organic electroluminescent display device and driving method thereof that substantially obviates one or more of the problems due to limitations and disadvantages of the related art.

An object of the present invention is to provide an organic electroluminescent display device with improved display quality and uniformity.

Another object of the present invention is to provide a method and apparatus for driving an organic electroluminescent display device that improves display quality and uniformity.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the organic electroluminescent display device and driving method thereof includes a method of driving an organic electroluminescent display device including measuring a gray level of an image, turning on a sampling transistor connected to gate electrode and drain electrode of a driving transistor during a sampling time, applying a data voltage to operate the driving transistor, and supplying a current to an light emitting diode through the driving transistor.

In another aspect, an organic electroluminescent display device includes a display panel including a plurality of pixels, at least one of the plurality of pixels including a switching transistor connected to a gate line and a data line, a driving transistor connected to a power line, a sampling transistor connected to the driving transistor and a sampling line, and a light emitting diode connected to the driving transistor to be supplied with a driving current; and a gray level measuring circuit to measure a gray level of an image, wherein a sampling time of a sampling clock signal applied to the sampling line is adjusted according to the gray level of the image.

In another aspect, a method of driving an organic electroluminescent display device including measuring a gray level of an image, storing an offset voltage corresponding to an operation property of a driving transistor of a pixel during a sampling time, the sampling time adjusted according to the gray level of the image, applying a data voltage to operate the driving transistor, and supplying a current to a light emitting diode through the driving transistor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 3:
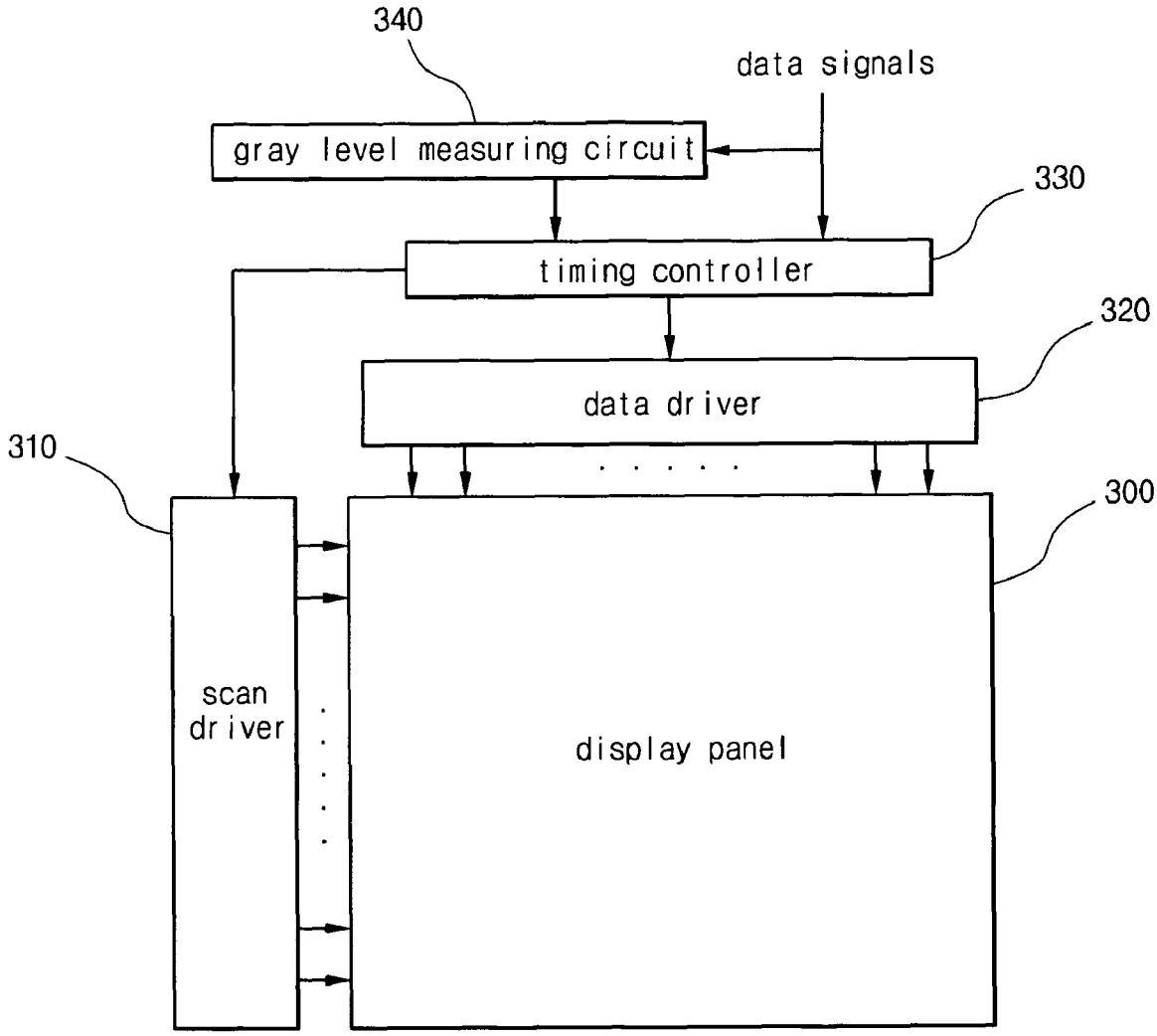
FIG. 3 is a block diagram illustrating an OELD device according to an exemplary embodiment of the present invention.
Figure 4:
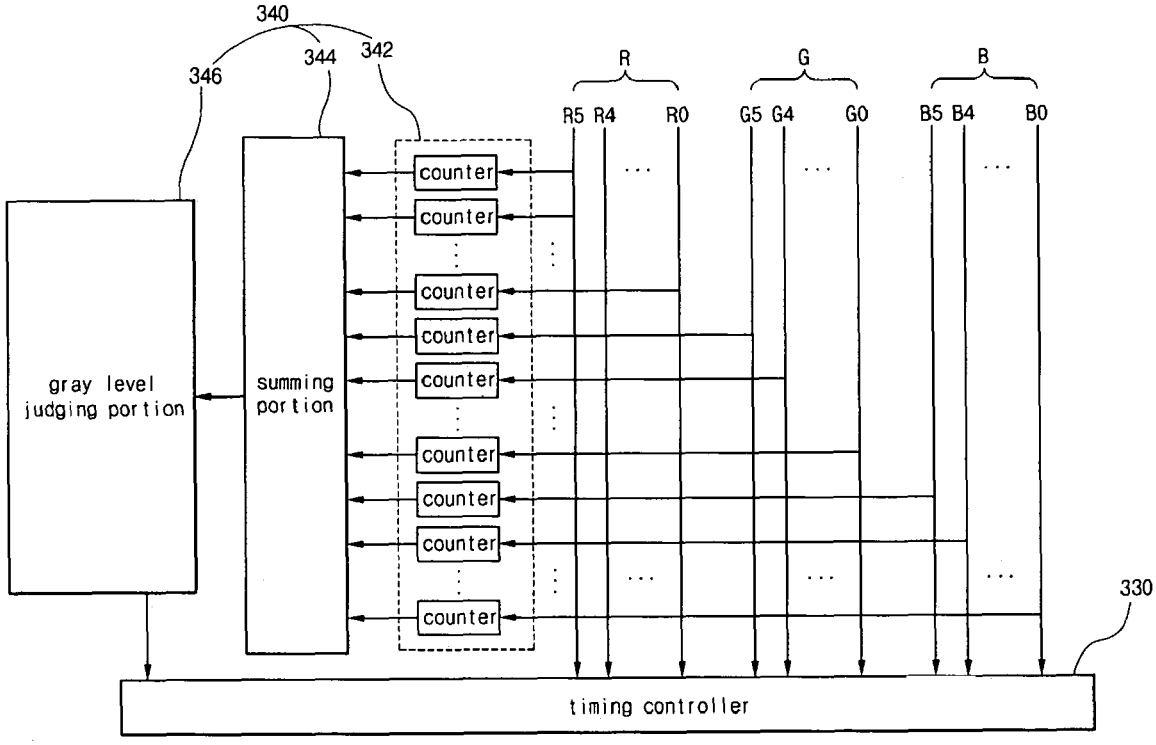
FIG. 4 is a block diagram illustrating an exemplary gray level measuring circuit of FIG. 3.

FIG. 3 is a block diagram illustrating an organic electroluminescent display (OELD) device according to an exemplary embodiment of the present invention. FIG. 4 is a block diagram illustrating an exemplary gray level measuring circuit of FIG. 3.

As illustrated in FIG. 3, the OELD device includes a display panel 300, a scan driver 310, a data driver 320, a timing controller 330, and a gray level measuring circuit 340. A pixel structure of the display panel 300 is similar to that of FIG. 2A. In particular, the display panel 300, according to the exemplary embodiment of the present invention, includes a plurality of pixels arranged in a matrix form. The pixel is connected to a gate line SL, a data line DL, and a power line $V_{DDL}$. The gate line SL and the data line DL intersect to define a pixel region. The pixel includes four transistors T1, T2, T3, and T4, two capacitors C1 and C2, and an organic light emitting diode OLED.

Figure 1:
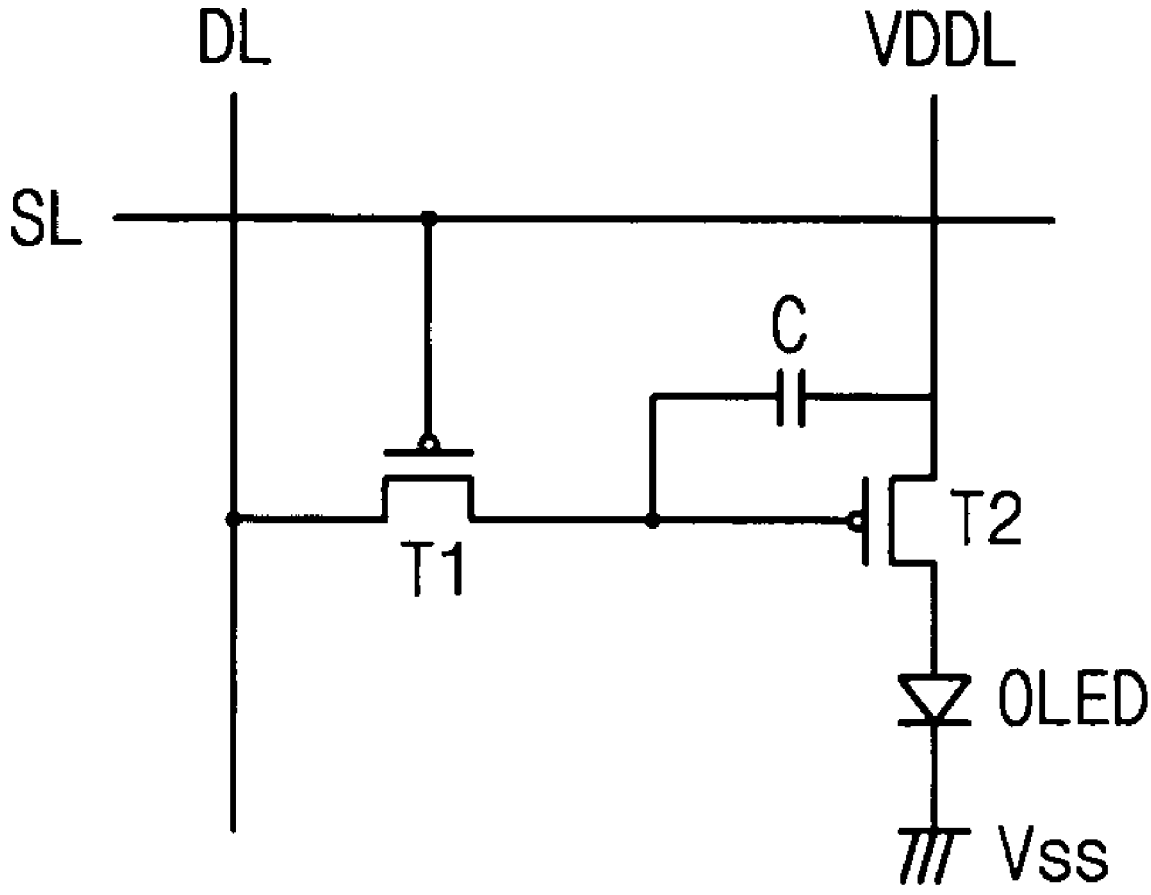
FIG. 1 RELATED ART
FIG. 1 is a circuit diagram illustrating an OELD device according to the related art.
Figure 2A:
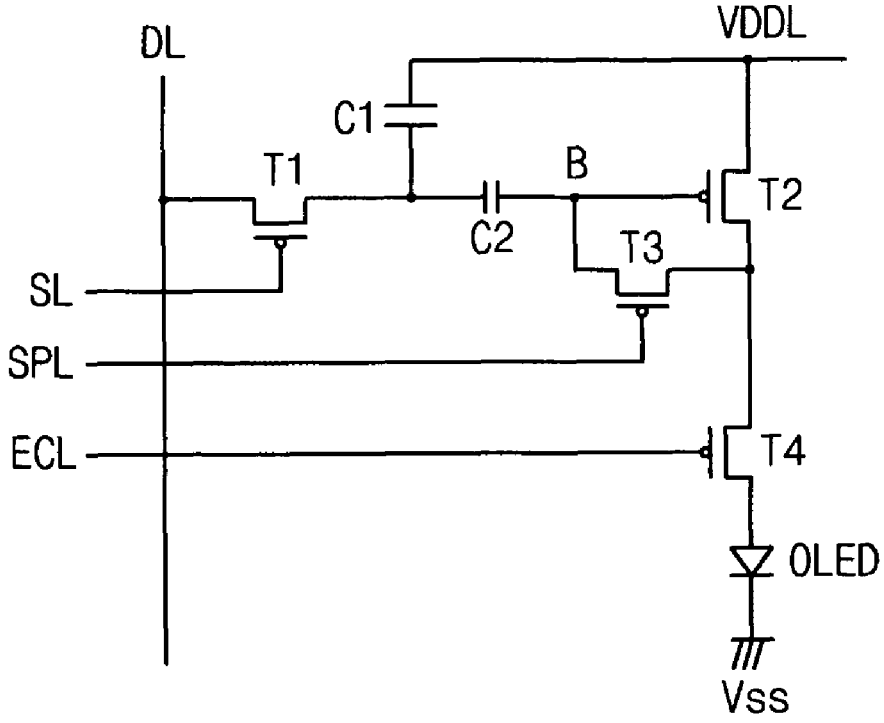
FIG. 2A RELATED ART
FIG. 2A is a circuit diagram illustrating a voltage compensation type OELD device according to the related art.
Figure 2B:
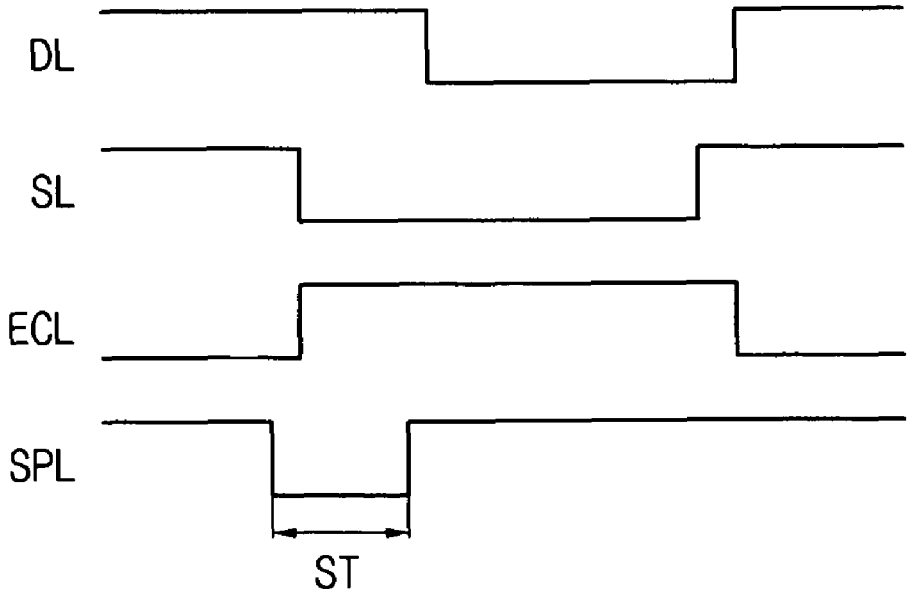
FIG. 2B RELATED ART
FIG. 2B is a waveform view illustrating signals applied to the OELD device of FIG. 2A.

Similar to the circuit shown in FIG. 2A, a pixel of the display panel 300, according to the exemplary embodiment of the present invention shown in FIG. 3, includes a switching transistor T1 is connected to the gate and data lines SL and DL. A driving transistor T2 has a source electrode connected to the power line $V_{DDL}$. A drain electrode of the driving transistor T2 is connected to a source electrode of an emitting control transistor T4. A sampling transistor T3 is connected to the gate and drain electrodes of the driving transistor T2. A gate electrode of the sampling transistor T3 is connected to a sampling line SPL. A gate electrode of the emitting control transistor T4 of a fourth transistor is connected to an emitting control line ECL. One electrode of a first capacitor C1 is connected to a drain electrode of the switching transistor T1, and the other electrode of the first capacitor C1 is connected to the source electrode of the driving transistor T2. One electrode of a second capacitor C2 is connected to the drain electrode of the switching transistor T1, and the other electrode of the second capacitor C2 is connected to the gate electrode of the driving transistor T2. An anode of the organic light emitting diode OLED is connected to the drain electrode of the emitting control transistor T4, and a cathode of the organic light emitting diode OLED is connected to a ground terminal $V_{SS}$.

The switching transistor T1 is turned on or off in accordance with a corresponding gate voltage level. The driving transistor T2 is operated in accordance with an operation of the switching transistor T1. The sampling transistor T3 is turned on or off in accordance with a corresponding sampling clock signal. By an operation of the sampling transistor T3, the offset voltage of the driving transistor T2 is sampled and stored in the second capacitor C2. That is, the second storage capacitor C2 functions to store a voltage reflecting the driving transistor T2 property sampled in accordance with a sampling time. The emitting control transistor T4 is on or off in accordance with a corresponding an emitting control signal. By an operation of the emitting control transistor T4, a diode current ($I_{OLED}$) flowing on the organic light emitting diode OLED is controlled.

The scan driver 310 sequentially scans the gate lines SL, the sampling lines SPL, and the emitting control lines ECL of one horizontal line to supply the gate voltage, the sampling clock signal, and the emitting control signal, respectively. The data driver 320 supplies data voltage of one horizontal line to the data lines DL in synchronization with the gate voltage, the sampling clock signal, and the emitting control signal. Although not shown in the drawings, the data driver 320 may include a shift register circuit, a latch circuit, a digital-to-analog converting circuit, and a buffer circuit. Data signals are converted into the data voltages by the digital-to-analog converting circuit.

The gray level measuring circuit 340 is provided with the data signals for displaying one frame of an image. The gray level measuring circuit 340 measures a gray level of the image using the data signals. The gray level measuring circuit 340 outputs a gray level information signal corresponding to the measured gray level to the timing controller 330.

The timing controller 330 generates control signals for controlling the scan driver 310 and data driver 320, and supplies the data signals to the data driver 320. The timing controller 330 generates control signals corresponding to the gray level information signal. For example, the timing controller 330 generates a sampling clock signal, and a sampling time of the sampling clock signal is adjusted. In other words, the sampling time is adjusted in accordance with the gray level of the image to be displayed.

As illustrated in FIG. 4, the gray level measuring circuit 340 includes a counting portion 342, a summing portion 344, and a gray level judging portion 346. The counting portion 342 counts bits of the data signals. For example, the data signals may include red, green, and blue data signals, and each of the red, green, and blue data signals may have six bits. The counting portion 342 may include a plurality of counters corresponding to a number of bits of the red, green, and blue signals. For example, first through sixth counters may correspond to sixth through first ordered bits, R5 to R0, of the red data signal, respectively. Seventh through twelfth counters may correspond to sixth through first ordered bits, G5 to G0, of the green data signal, respectively. Thirteenth through eighteenth counters may correspond to sixth through first ordered bits, B5 to B0, of the blue data signal, respectively. Each counter counts a value of the corresponding bit.

The summing portion 344 sums the values counted by the plurality of counters of the counting portion 342. The value summed by the summing portion 344 represents a gray level of an image. A higher summed value represents a higher gray level of the image.

The gray level judging portion 346 judges the gray level using the summed value, and outputs a gray level information signal reflecting the gray level. In other words, the gray level judging portion 346 monitors the summed value, and outputs the gray level information signal as a result of the monitoring. The gray level information signal has different values for the different summed values. Through the above operations of the counting portion 342, the summing portion 344, and the gray level judging portion 346, the gray level of the image is measured.

The timing controller 330 generates the sampling clock signal having the sampling time according to the gray level information signal. The sampling clock signal is supplied to the scan driver 310. For images of different gray levels, different sampling times may be used. For example, all gray levels displayed by the OELD device may be categorized into at least two gray level groups. Images of the same gray level group may have the same sampling time, and images of the different gray level groups may have different sampling times. In another example, all gray levels may be divided into three gray level groups, such as low, middle, and high gray level groups. The low, middle, and high gray level groups may have first, second, and third sampling times, respectively. The timing controller 330 may use a look-up table (LUT) where input-to-output relationship is defined to associate gray level groups and their respective sampling times.

Figure 5A:
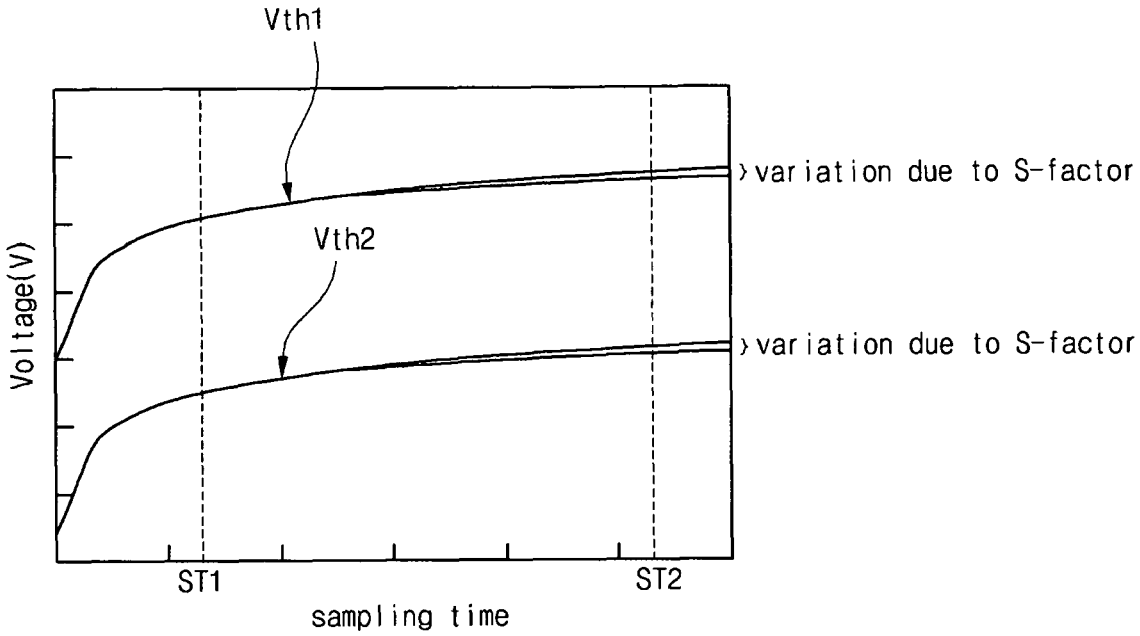
FIG. 5A is a graph illustrating voltage applied to a gate electrode of a driving transistor over a sampling time according to an exemplary embodiment of the present invention.
Figure 5B:
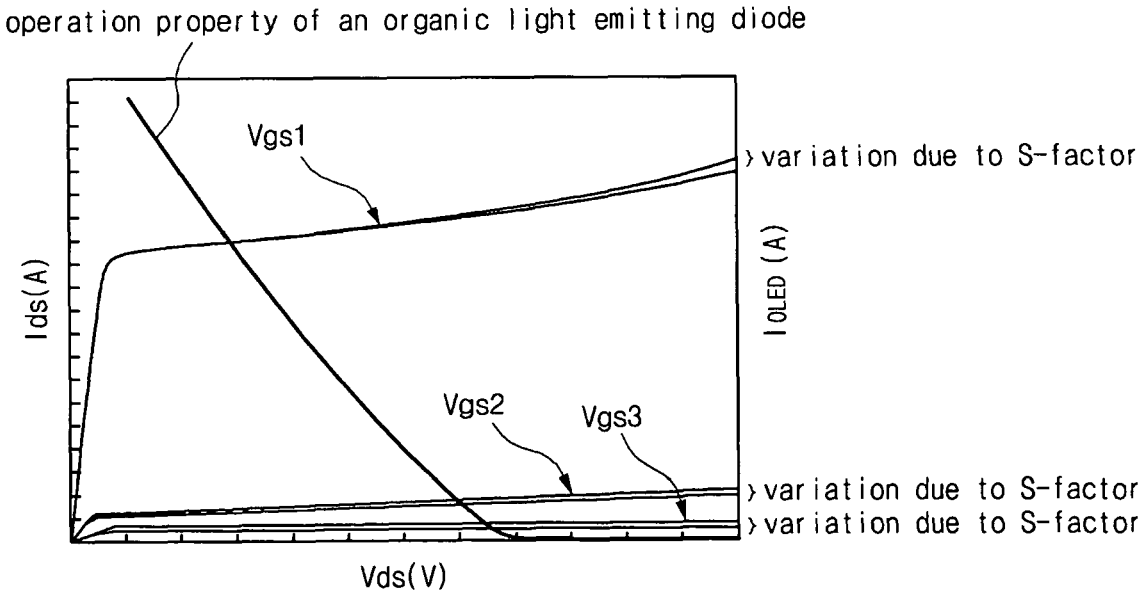
FIG. 5B is a graph illustrating operating points of a driving transistor adequate to gray levels according to an exemplary embodiment of the present invention.

A method of driving the OELD device according to an exemplary embodiment of the present invention is explained with reference to FIG. 5A and FIG. 5B. FIG. 5A is a graph illustrating voltage applied to a gate electrode of a driving transistor T2 according to sampling time. FIG. 5B is a graph illustrating operating points of a driving transistor T2 adequate to gray levels.

As illustrated in FIG. 5A, voltages applied to gate electrodes of different driving transistors T2 converge at different points due to different threshold voltages $V_{th1}$ and $V_{th2}$. Also, slopes of voltages applied to gate electrodes of different driving transistors T2 are different due to different S-factors. As the sampling time gets longer, difference of the voltages applied increases due to the different S-factors. Therefore, a short sampling time ST1 is preferred for storing the offset voltage when the gray level is not influenced by the S-factor property. A longer sampling time ST2 is preferred for storing the offset voltage when the gray level is influenced by the S-factor property.

As shown in FIG. 5B, $V_{ds}$ is a voltage between drain and source electrodes of a driving transistor T2, and $I_{ds}$ is a current flowing through a channel between the drain and source electrodes of the driving transistor T2. As illustrated in FIG. 5B, a diode current supplied to an organic light emitting diode OLED through the driving transistor T2 is influenced not only by a gate-source voltage $V_{gs1}$, $V_{gs2}$, and $V_{gs3}$, but also by the S-factor.

FIG. 5B illustrates an operation property curve of the organic light emitting diode OLED. For a high gray level, an adequate operation point of the driving transistor T2 is formed at a point, where an influence by the S-factor is low. In other words, the point is a crossing point of a high gate-source voltage ($V_{gs1}$) and the operation property curve of the organic light emitting diode OLED. For a low gray level, an adequate operation point of the driving transistor T2 is formed at a point, where an influence by the S-factor is high, and thus a current difference due to the S-factor is great, e.g., a crossing point of a low gate-source voltage ($V_{gs3}$) and the operation property curve of the organic light emitting diode OLED. Accordingly, since the high gray level is not significantly influenced by the S-factor, a short sampling time ST1 is adequate. However, since the low gray level is influenced by the S-factor, a longer sampling time ST2 is needed. Therefore, various gray levels can be compensated uniformly, and thus display quality uniformity is improved.

As explained above, a gray level of an image is measured by the grey level judging portion 346 after the counting and summing bit values of data signals of the image. A sampling time is adjusted in accordance with the measured gray level such that the offset voltage of the driving transistor T2 is stored during the sampling time. The sampling time is varied according to the gray level of the image. The sampling time is short if the image has a high gray level, and the sampling time is longer if the image has a low gray level. When the data voltage is applied to operate the driving transistor T2 for displaying the image, the operation of the driving transistor T2 is offset by the offset voltage stored previously.

In the above exemplary embodiment, the sampling time for storing the offset voltage of driving transistor T2 is varied such that the operation of the driving transistor T2 is sampled. Accordingly, images having different gray levels are all displayed uniformly. Therefore, display uniformity can be improved.

It will be apparent to those skilled in the art that various modifications and variations can be made in the organic electroluminescent display device and driving method thereof includes of the present invention without departing from the spirit or scope of the invention. Thus, it is intended that the present invention cover the modifications and variations of this invention provided they come within the scope of the appended claims and their equivalents.

What is claimed is:

1. An organic electroluminescent display device, comprising:

a display panel including a plurality of pixels, at least one of the plurality of pixels including, a switching transistor connected to a gate line and a data line, a driving transistor connected to a power line, a sampling transistor connected to the driving transistor and a sampling line, and a light emitting diode connected to the driving transistor to be supplied with a driving current; and a gray level measuring circuit to measure a gray level of an image, wherein a sampling time of a sampling clock signal applied to the sampling line is adjusted according to the gray level of the image, and wherein the one of the plurality of pixels includes an emitting control transistor connected to an emitting control line to connect the driving transistor and the light emitting diode.

2. The device according to claim 1, wherein the sampling time for an image of a high gray level is shorter than the sampling time for an image of a low gray level.

3. The device according to claim 1, wherein a first sampling time corresponds to a first image and a second sampling time corresponds to a second image.

4. The device according to claim 3, wherein the first image has a first gray level, and the second image has a second gray level.

5. The device according to claim 3, wherein the first gray level is different than the second gray level.

6. The device according to claim 1, wherein the gray level is one of a plurality of gray levels, the plurality of gray levels being divided into a plurality of gray level groups.

7. The device according to claim 6, wherein each gray level group is associated with a different sampling time.

8. The device according to claim 7, wherein each gray level group and associated sampling time is stored in a look-up table.

9. The device according to claim 1, further comprising:

a data driver connected to the data line;

a scan driver connected to the gate line and the sampling line; and a timing controller to control the scan driver and the data driver, the timing controller connected to the gray level measuring circuit to generate the sampling clock signal using the gray level of the image.

10. The device according to claim 1, wherein the gray level measuring circuit includes:

a counting portion to count bit values of a plurality of data signals of the image;

a summing portion to sum the counted bit values; and a gray level judging portion to determine the gray level using a value summed by the summing portion.

11. The device according to claim 10, wherein the counting portion includes a plurality of counters.

12. The device according to claim 1, wherein the one of the plurality of pixels includes a first capacitor connected to the switching transistor and the power line, and a second capacitor connected to the switching transistor and the driving transistor.

13. A method of driving an organic electroluminescent display device, comprising:

measuring a gray level of an image;

storing an offset voltage corresponding to an operation property of a driving transistor of a pixel during a sampling time, the sampling time adjusted according to the gray level of the image;

applying a data voltage to operate the driving transistor; and supplying a current to a light emitting diode through the driving transistor.

14. The method according to claim 13, wherein the sampling time for an image of a high gray level is shorter than the sampling time for an image of a low gray level.

15. The method according to claim 13, wherein a first sampling time corresponds to a first image and a second sampling time corresponds to a second image.

16. The method according to claim 15, wherein the first image has a first gray level, and the second image has a second gray level.

17. The method according to claim 16, wherein the first gray level is different than the second gray level.

18. The method according to claim 13, wherein the gray level is one of a plurality of gray levels, the plurality of gray levels being divided into a plurality of gray level groups.

19. The method according to claim 18, wherein each gray level group is associated with a different sampling time.

20. The method according to claim 19, wherein each gray level group and associated sampling time is stored in a look-up table.

21. The method according to claim 13, wherein measuring the gray level of the image includes:

counting bit values of a plurality of data signals of the image;

summing the bit values counted; and determining the gray level using a value summed by the summing portion.

22. The method according to claim 21, wherein the bit values are counted using a plurality of counters corresponding to a number of bits of the data signal.

23. A method of driving an organic electroluminescent display device, comprising:

measuring a gray level of an image;

turning on a sampling transistor connected to gate electrode and drain electrode of a driving transistor during a sampling time, the sampling time varied according to the gray level;

applying a data voltage to operate the driving transistor; and supplying a current to a light emitting diode through the driving transistor.

24. The method according to claim 23, wherein the sampling time for a high gray level image is shorter than the sampling time for a low gray level image.

* * * * *